United States Patent [19]

Marcus

[11] Patent Number: 4,671,420

[45] Date of Patent: Jun. 9, 1987

[54] TAMPER EVIDENT CONTAINER WITH INTEGRAL TEAR STRIP

[76] Inventor: Paul Marcus, 85 Pascack Rd., Pearl River, N.Y. 10965

[21] Appl. No.: 805,612

[22] Filed: Dec. 6, 1985

[51] Int. Cl.[4] ..... B65D 1/02

[52] U.S. Cl. ..... 215/32

[58] Field of Search ..... 215/32

[56] References Cited

U.S. PATENT DOCUMENTS

| | | | |
|---|---|---|---|
| 1,690,441 | 11/1928 | Breckenridge . | |
| 3,083,858 | 4/1963 | Biedenstein | 215/32 X |
| 4,019,663 | 4/1977 | Krautkramer | 215/32 X |
| 4,024,976 | 5/1977 | Acton | 215/32 |

FOREIGN PATENT DOCUMENTS

WO79/00722 10/1979 PCT Int'l Appl. .

*Primary Examiner*—Donald F. Norton

*Attorney, Agent, or Firm*—Kane, Dalsimer, Kane, Sullivan and Kurucz

[57] ABSTRACT

A plastic container is produced as an integral unit comprising a container body, a container neck extending from the container body, a tear strip on the container neck, and a cap portion connected to the tear strip, said cap portion having an opening in a top position thereof, said container being adapted to be filled through the opening in said cap, and a separately produced lid means adapted to cover and seal the opening in the cap. After removal of the tear strip the cap serves as a closure for the container.

10 Claims, 25 Drawing Figures

FIG.4
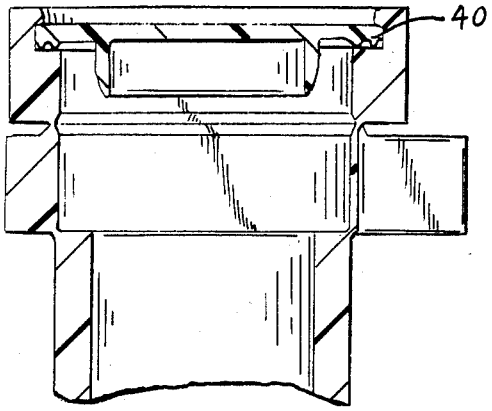
FIG.5
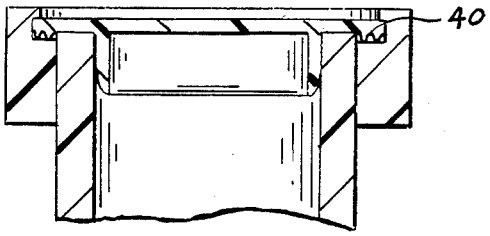
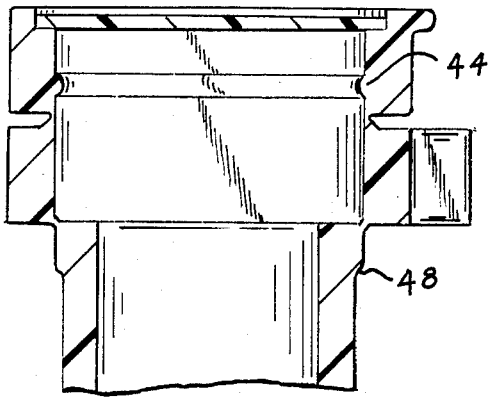
FIG.6
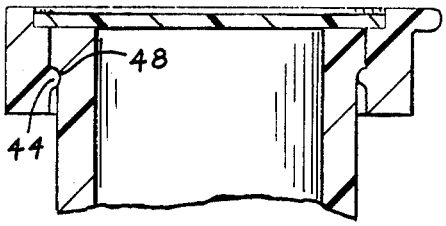
FIG.7
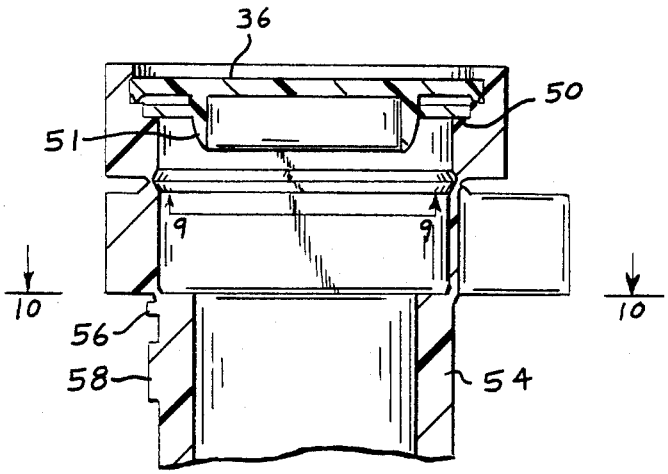
FIG.8

FIG.12
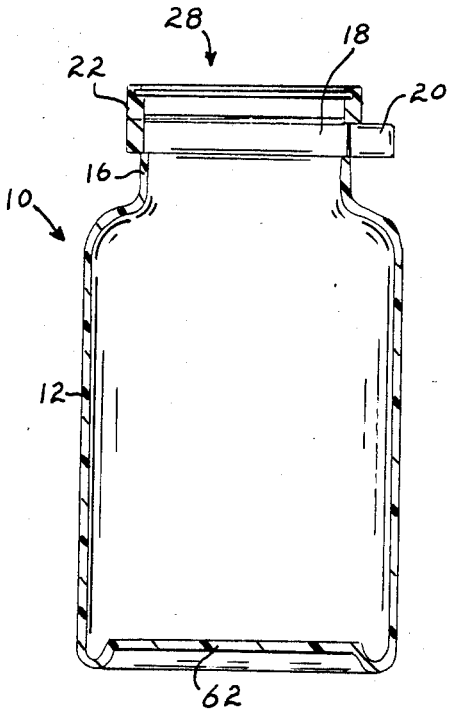
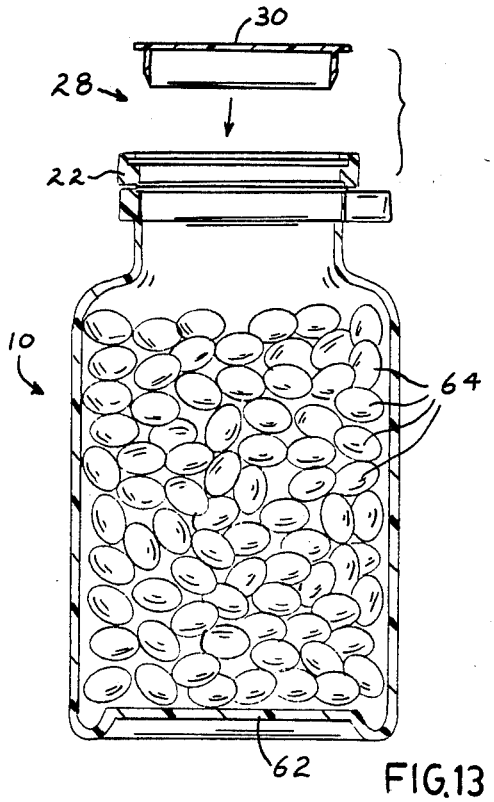
FIG.13
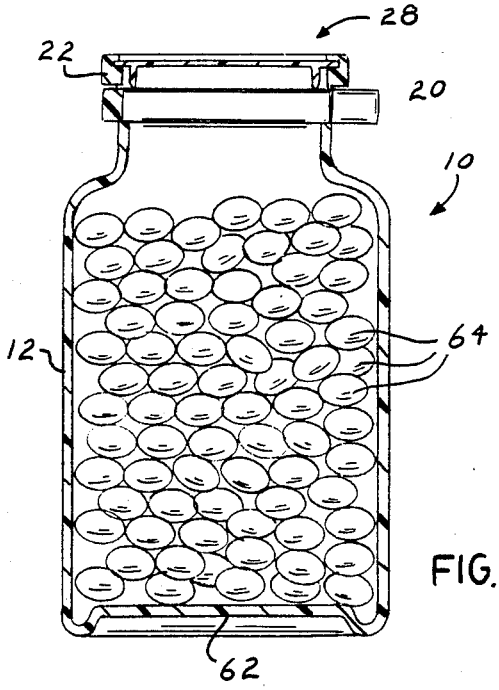
FIG.14

FIG.15
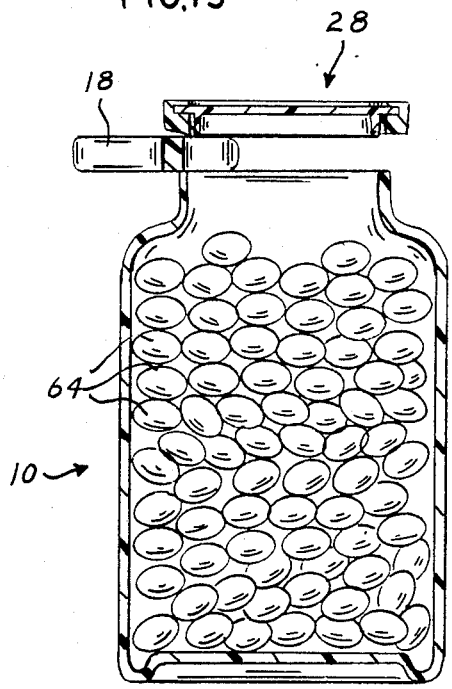
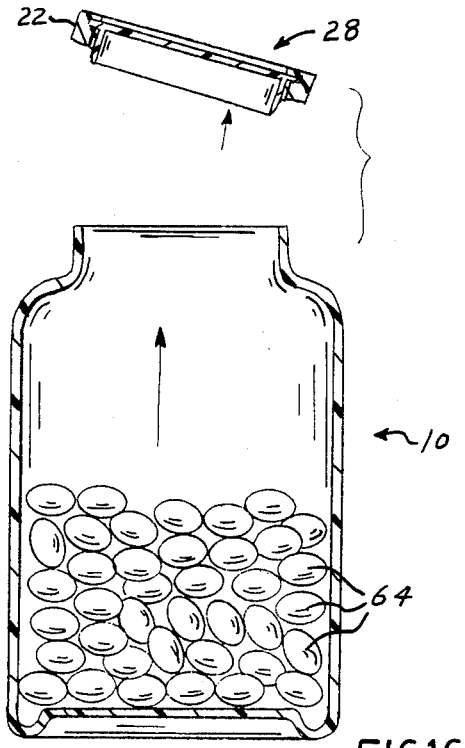
FIG.16
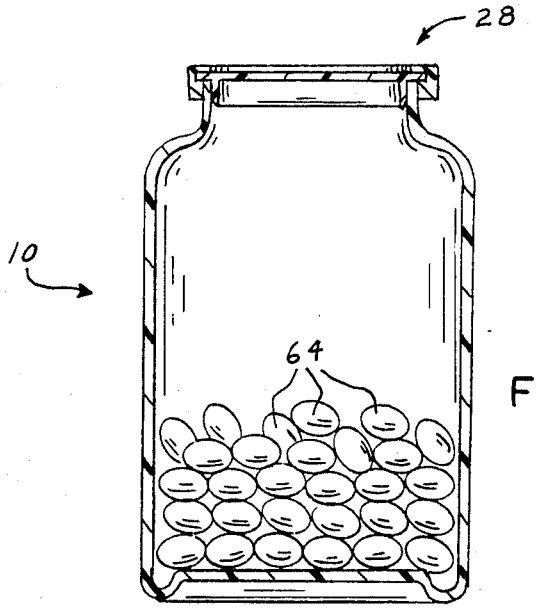
FIG.17

FIG. 20
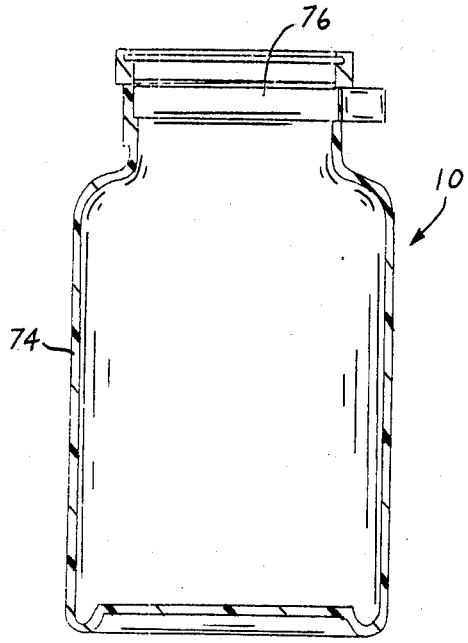
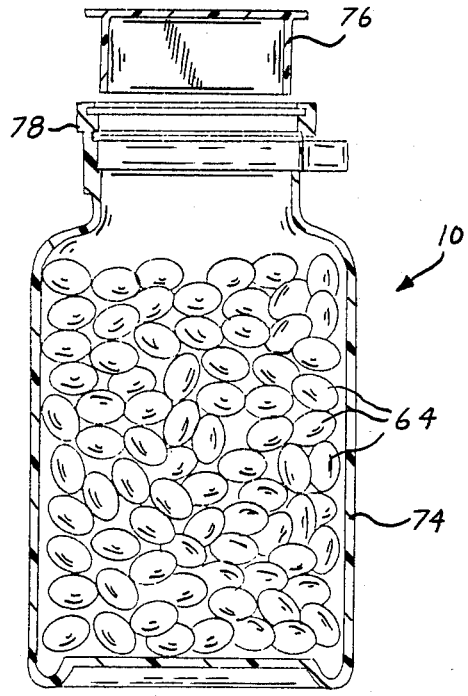
FIG. 21
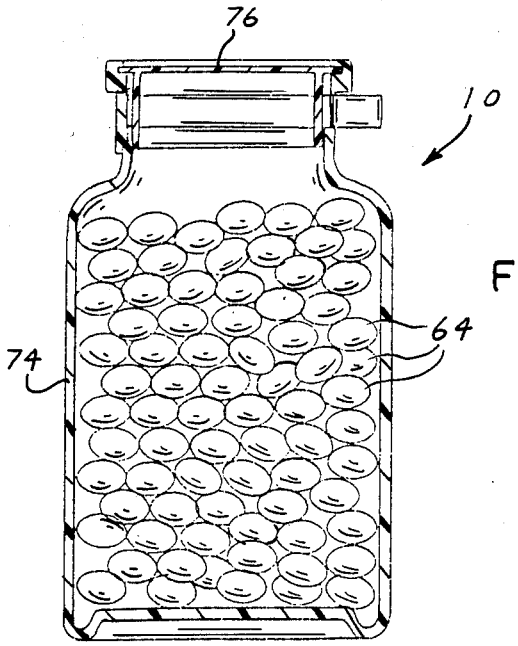
FIG. 22

TAMPER EVIDENT CONTAINER WITH INTEGRAL TEAR STRIP

FIELD OF THE INVENTION

The present invention pertains to tamper evident containers and more particularly to a plastic container having a tear strip produced integrally therewith.

BACKGROUND OF THE INVENTION

A wide variety of tamper evident containers are known. Common means for producing tamper evident containers include provision of frangible ribs connecting a removable cap to a semipermanent collar on the bottle neck, enshrouding the container cap with a plastic sheath, provision of one a variety of tear strip means, and others. However, an integrally molded tamper evident container having the convenience of top filling has not been provided in the prior art.

U.S. Pat. No. 4,019,663 (Krautkramer) discloses a container closure having a tear strip molded as an integral part thereof. However, the Krautkramer closure is not integral with a container body.

U.S. Pat. No. 1,690,441 (Breckenridge) discloses a can having an integral body, tear strip, and cap. The Breckenridge patent does not teach top filling and contains a lid having limited capacity for sealing the contents of the container.

PCT application No. WO 79/00722 (Harild) discloses an integrally molded container having a tear strip wherein the container is filled with product through a bottom opening, and wherein a limited closure means is disclosed for closing the container after removal of the tear strip.

As can be seen from the above, prior art containers having an integral tear strip have not suggested top loading and are extremely limited in their closure capabilities.

SUMMARY OF THE INVENTION

The primary object of the present invention is to provide a tamper evident container of ultimate simplicity in manufacture, having top filling capacity and having an improved closure means.

The invention provides a plastic container produced as an integral unit comprising a container body, a container neck extending from the container body, a tear strip on the container neck, and a cap portion connected to the tear strip, said cap portion having an opening in a top position thereof, said container being adapted to be filled through the opening in said cap, and a separately produced lid means adapted to cover and seal the opening in the cap.

BRIEF DESCRIPTION OF THE DRAWINGS

FIGS. 4 and 5 are side section views of a second embodiment having a sealing gasket on the cap portion, FIG. 5 representing a closed position.

FIGS. 6 & 7 are side sections views of a third embodiment of the present invention having cooperating thread or bead and indentation means, FIG. 7 representing a closed position.

FIGS. 8 & 11 are side section views of a fourth embodiment of the invention, FIG. 11 representing a closed position.

FIGS. 12–17 are side section views of the container of FIG. 1 in varying stages of production and use wherein;

FIG. 12 illustrates the container, as manufactured, as an integral piece;

FIG. 13 illustrates the container filled with product, and a lid member being inserted into the cap portion;

FIG. 14 illustrates the container having the lid member affixed to the cap portion;

FIG. 15 illustrates the tear strip being removed;

FIG. 16 illustrates the container in use; and

FIG. 17 illustrates the container in use, in a closed position, having product partially removed therefrom.

FIGS. 20–25 are side sectional views of the container of FIG. 18 wherein;

FIG. 20 illustrates the container, as manufactured, as an integral piece;

FIG. 21 illustrates the container filled with product, and a lid member being inserted into the cap portion;

FIG. 22 illustrates the container having the lid member affixed to the cap portion;

FIG. 23 illustrates tearing of the tear strip;

FIG. 24 illustrates the hinged cap portion in an open position; and

FIG. 25 illustrates the hinged cap portion in a closed position.

DETAILED DESCRIPTION OF THE PREFERRED EMBODIMENTS

Figure 1:
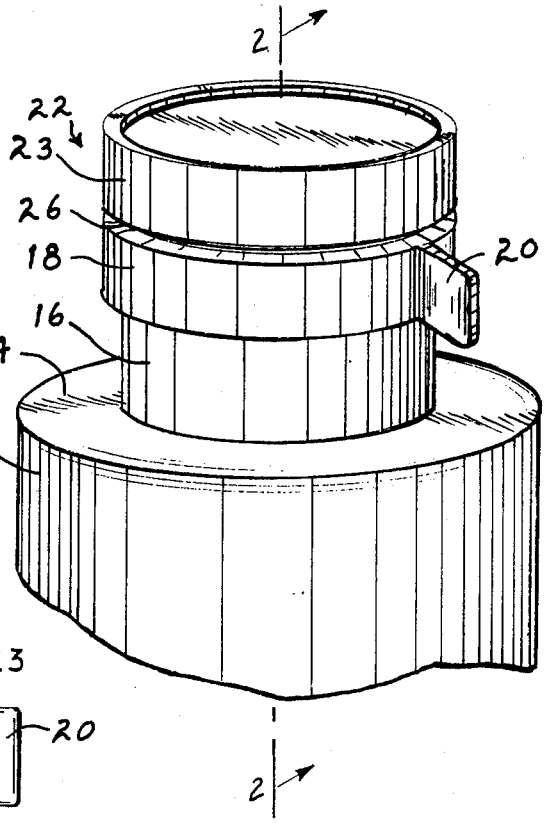
FIG. 1 is a perspective view of a first embodiment of the present invention.
Figure 2:
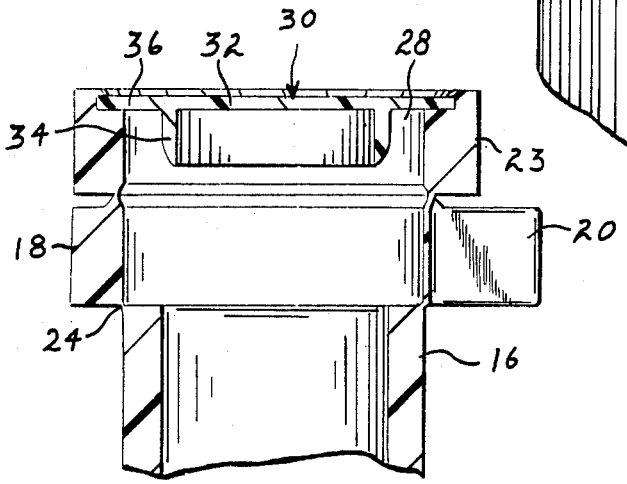
FIG. 2 is a side section view of the first embodiment of the present invention having a lid member affixed to the cap.

FIG. 1 illustrates a container 10 having a body 12, a shoulder 14, a neck 16, a tear strip 18 having a pull tab 20, and a cap 22 having side walls 23, the cap having an aperture 28 (see FIG. 2). Container 10 is composed of an integral plastic piece which is preferably manufactured by either injection molding, injection blow molding or extrusion blow molding. Weakened line 24 is disposed between neck 16 and tear strip 18. Weakened line 26 is disposed between tear strip 18 and cap 22 respectively. Weakened lines 24 and 26 facilitate tearing tear strip 18 from the neck and from the cap, respectively.

FIG. 2 is a section view of a first embodiment of the invention. An upper portion of a container, including neck 16, tear strip 18, and cap 22, are shown. This view illustrates lid member 30 mounted in cap 22, a sealing compound may be applied to secure the seal therebetween. Alternately an undercut, swedge, crimp, press or heat seal may be provided between the cap and the lid member 30. Lid member 30 has a flat disc portion 32 and an annular member 34 extending perpendicularly downward therefrom. Flange member 36 of disc portion 32 extends radially outward of the perimeter of the annular member 34.

Figure 3:
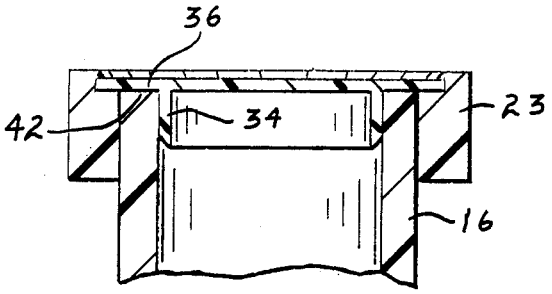
FIG. 3 is a side section view of the embodiment of FIG. 2, after removal of the tear strip, in a closed position.
Figure 10:
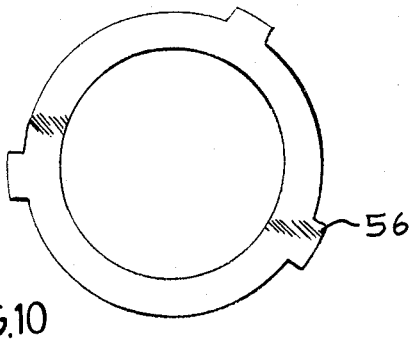
FIG. 10 is a plan view, from above, of the container neck taken along line 10—10 of FIG. 8.

FIG. 3 is a view of the container of FIG. 2 in a closed position. Annular member 34 has an outer diameter which is substantially equal to the inner diameter of container neck 16 so that a friction fit is provided between annular member 34 and container neck 16 to seal container 10. Flange member 36 rests upon an upper edge 42 of the container neck in a closed position and side walls 23 of cap 22 are disposed outwardly of the neck wall.

To arrive at the "closed" position of FIG. 3, tear strip 18 is torn away along weakened lines 24 and 26, and cap 22, having lid member 30 mounted therein, is mounted on container neck 16 as shown.

FIGS. 4 and 5 illustrate a second embodiment of the invention. In this embodiment flange member 36 of the lid member 30 contains a gasket 40 circumferentially disposed on the lower side thereof. The gasket provides an alternative sealing means between cap 22 and lid member 30. FIG. 5 represents the closed position of the container. Removal of tear strip 18 and closing of the container takes place as described in the discussion of FIGS. 1-3.

FIGS. 6 and 7 illustrate a third embodiment of the invention wherein a screw thread or bead 44 is provided in the interior surface of walls 23 of cap 22. In this embodiment the lid member is a disc member 46 which is mounted in cap 22. A ridge 48 is provided on the container neck to act as a screw thread or bead in cooperation with screw thread or bead 44. FIG. 5 illustrates a closed position. To close the container after tear strip 18 is torn away, cap 22 is screwed into sealing engagement with container neck 16.

Figure 9:
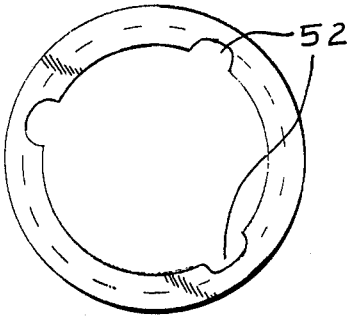
FIG. 9 is a plan view, from below, of the cap portion, taken along line 9—9 of FIG. 8.
Figure 11:
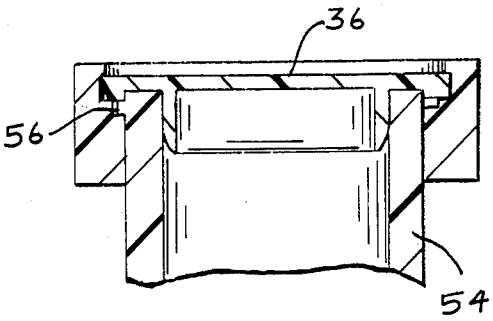

FIGS. 8–11 illustrate a fourth embodiment of the invention. In this embodiment the lid member further comprises a second flange 50, below flange 36, and extending radially outward from annular member 51. The second flange is shown in FIG. 9 and contains notches 52. Bottle neck 54 further comprises ribs 56 and raised portions 58 for interlocking with second flange 50. After tear strip 16 is removed, cap 60 is mounted on bottle neck 54 by inserting annular member 51 into the opening in bottle neck 16 and placing notches 52 over raised portions 58, passing the second flange over the ribs 56, and rotating the cap so that the notches are no longer aligned with the ribs 56. In this embodiment, as in the embodiments of FIGS. 3 and 5, annular member 51 contacts the inner surface of bottle neck 16, however, since rotation is necessary for locking, the amount of friction in the fit between annular member 34 and bottle neck 16 should be limited.

FIGS. 12–17 illustrate steps in the production of and use of the container of FIG. 1. FIG. 12 illustrates an empty container 10, as illustrated in FIG. 1, composed of an integral plastic piece, having a bottom 62, having a lip to provide a durable member for container to surface contact, a body 12, a shoulder 14, a neck 16, a tear strip 18 having a pull tab 20, and a cap 22 having an opening therein. As illustrated in FIG. 13, container 10 is then filled with product 64 through aperture 28. Lid member 30 is then mounted into cap 22 and sealed thereto. Any of a variety of sealing compounds may be used to seal lid member 30 to cap 22. FIG. 14 illustrates container 10 containing product 64, in the condition in which product is sold at retail.

FIG. 15 illustrates removal of tear strip 18 by tearing along weakening lines 24 and 26. FIG. 16 illustrates displacement of cap 22 (containing lid member 30) from container 10. The arrow in the figure represents removal of product from the container by a consumer. FIG. 17 illustrates closure of container 10 after removal of contents therefrom.

Figure 18:
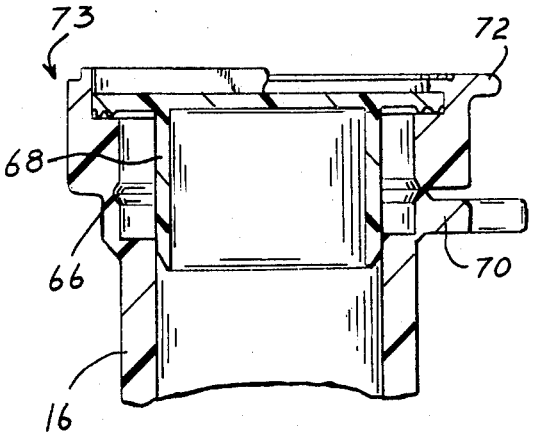
FIGS. 18 and 19 illustrate a fifth embodiment of the present invention, having a hinge feature, FIG. 18 being a split view, and FIG. 19 illustrating a closed position.
Figure 19:
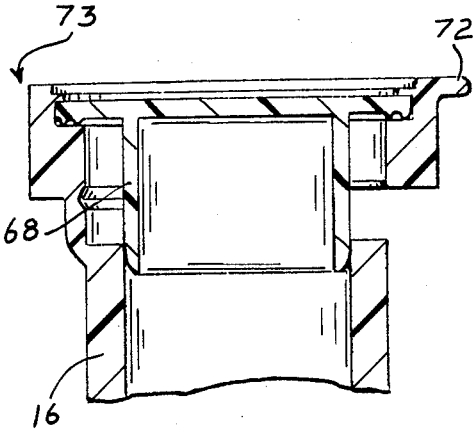

FIGS. 18 and 19 illustrate a fourth embodiment of the present invention. FIG. 18 is a split view, the left side showing the lid member mounted into the cap before sealing, the right side of FIG. 18 showing the same after sealing. In the embodiment the cap is hingedly connected to neck 16 by a hinge 66. The hinge is preferably composed of a polyethylene, P.V.C., P.E.T. or polypropylene material. Annular member 68 has longer walls in this embodiment because the cap is not removed upon tearing tear strip 70, but instead, after removal of tear strip 70 (FIG. 19), the cap remains hingedly coupled to bottle neck 16. Annular member 68 must therefore span the vertical length of the cap, hinge, and tear strip so that the lower portion of the cap is inserted into the bottle neck. A pry-off tab 72 is contained on cap 73 and is used to press open the cap. The pry off-tab is generally pushed by the thumb of the user to open the container 10.

FIGS. 20–25 illustrate steps in the production and use of the embodiment of FIG. 18. FIG. 20 illustrates an empty container 74 composed of an integral plastic piece having an aperture 76 for filling. FIG. 21 illustrates container 74 filled with product 64 and a lid member 76 being mounted into cap 78. FIG. 22 illustrates container 74 filled with product 64 having lid member 76 sealed into cap 78. It is in this condition that the container with product is sold.

Figure 23:
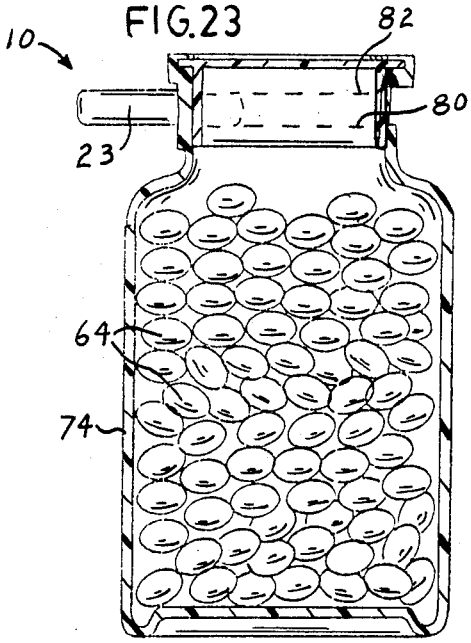
Figure 24:
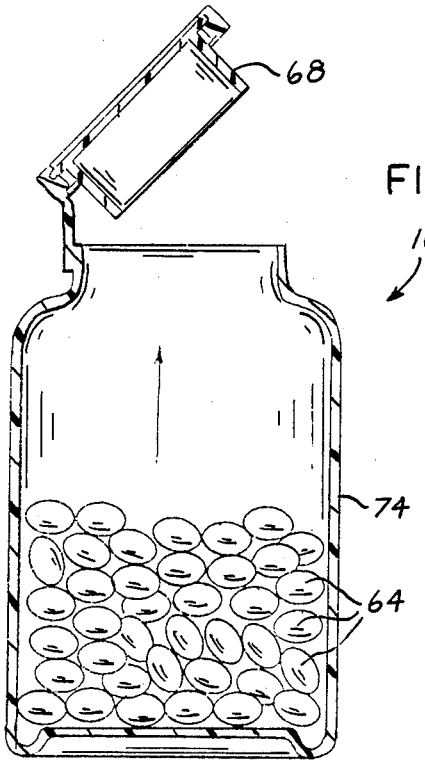
Figure 25:
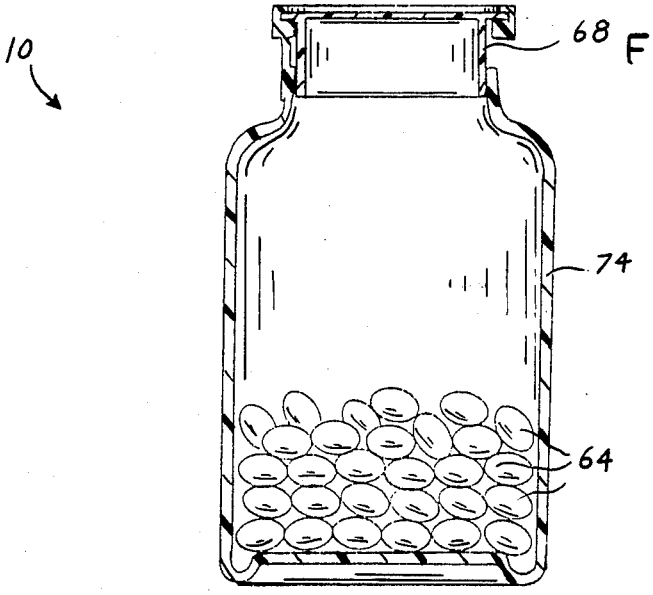

FIG. 23 illustrates removal of tear strip 70 by tearing along weakening lines 80 and 82. FIG. 24 illustrates opening of cap 78 about hinge 66 to access the contents of container 74. FIG. 25 illustrates container 74 in a closed position, cap 78 being hingedly closed so that annular member 68 is frictionally inserted into the container neck.

Although a detailed description of the preferred embodiments of the present invention has been described, it is to be understood that the scope of the present invention is not to be limited thereby, but is to be determined by the claims which follow.

What is claimed is:

1. A plastic container produced as an integral unit comprising a container body, a container neck extending from the container body, a tear strip on the container neck, and a cap portion located above the container neck and connected to the tear strip, said cap portion having an opening in a top portion thereof, said container being adapted to be filled with product through the opening in said cap; and further comprising a separately produced lid means adapted to cover and seal the opening in the cap portion, said lid means cooperating with the cap portion to form a closure means.

2. The container of claim 1 wherein the tear strip extends about the entire circumference of bottle neck, and wherein the closure means further comprises a stopper means, said stopper means being adapted to close an opening in the container neck after removal of the tear strip from the container, the position wherein the stopper means closes the opening in the container neck defining a closed position.

3. The container of claim 2 wherein the stopper means is integral with the lid means.

4. The container of claim 2 wherein the cap portion is affixed to the tear strip along a circumferential weakened line, the portion of the cap affixed to the tear strip being a radially outward portion of the cap wall, the stopper means being located spaced from and interiorly thereof.

5. The container of claim 4 wherein the lid means of the closure means comprises a flat top portion and the annular member affixed to the bottom side of the flat top portion and extending substantially perpendicularly therefrom, the annular member having an outside diameter substantially equivalent to an inside diameter of the container neck, said closure means adapted to seal the opening which is created in the container neck after removal of the tear strip by a friction fitting, the flat top portion being perpendicular to and extending radially outward from the annular member.

6. The container of claim 5 further comprising a gasket circumferentially disposed on the bottom side of the flat top portion and adapted to seal the opening in the container neck in the closed position.

7. The container of claim 2 wherein an upper and a lower flange extend radially outwardly from the annular member, the lower flange containing at least two apertures disposed radially thereabout, and wherein the bottle neck further comprises at least two ribs corresponding to the apertures in the second flange, and dimensioned so that the apertures can slide over the bottle neck, further comprising at least two abutment means corresponding to the ribs wherein, in a closed position, the cap is affixed to the bottle neck by slipping the apertures of the second flange over the ribs and rotating the cap so that the apertures no longer align with the ribs.

8. The container of claim 1 wherein the cap further comprises a wall having a screw thread on the internal surface thereof and wherein the bottle neck contains a ridge adapted to cooperate with the thread on the cap wall to threadingly engage the cap to the bottle neck in a closed position.

9. The container of claim 1 further comprising a hinge means hingedly coupling the bottle neck and cap so that upon removal of the tear strip the cap may be hingedly detached from the opening in the bottle neck.

10. The container of claim 9 further comprising a pryoff tab on the cap to facilitate pushing the cap from the opening in the bottle neck, the annular member being elongated to span the vertical lengths of the cap and tear strip.

* * * * *